United States Patent [19]

Fujie et al.

[11] Patent Number: 4,842,500

[45] Date of Patent: Jun. 27, 1989

[54] VANE PUMP WITH POSITIONING PINS FOR CAM RING

[75] Inventors: Tohru Fujie; Yoshio Hirose, both of Atsugi, Japan

[73] Assignee: Atsugi Motor Parts Company, Limited, Japan

[21] Appl. No.: 230,701

[22] Filed: Aug. 9, 1988

Related U.S. Application Data

[63] Continuation of Ser. No. 40,333, Apr. 20, 1987, abandoned.

[30] Foreign Application Priority Data

May 20, 1986 [JP] Japan ..... 61-117066

[51] Int. Cl.[4] ..... F04C 2/344

[52] U.S. Cl. ..... 418/133; 29/156.4 R

[58] Field of Search ..... 418/133, 135; 417/300; 29/156.4 R, 464

[56] References Cited

U.S. PATENT DOCUMENTS

| | | | |
|---|---|---|---|
| 2,733,687 | 2/1956 | Schmid | 418/133 |
| 3,289,601 | 12/1966 | Compton | 418/135 X |
| 4,201,521 | 5/1980 | Carlson | 418/135 X |
| 4,573,890 | 3/1986 | Hadama et al. | 418/133 X |

*Primary Examiner*—John J. Vrablik

*Attorney, Agent, or Firm*—Lane and Aitken

[57] ABSTRACT

A vane pump comprising a housing having front and rear surfaces and formed with a cam ring housing portion which is open to the front surface, the housing being further formed at its inner peripheral wall with recess portions and an axial bore extending from the rear surface, said axial bore being open to a center of the ring housing portion; a drive shaft freely rotatably supported in the axial bore of the housing; a rotor inserted on the drive shaft and engaged with the drive shaft, the rotor having a plurality of slits and a plurality of vanes each projectable from and retractable in the corresponding slit; a cam ring having at its inner peripheral wall a cam surface which is arranged to enclose the rotor therein and form pump chambers in cooperation with the vanes, the cam ring being formed at its outer peripheral wall with recess portions of substantially semicircular configuration in cross section; a front end plate by which the cam ring is closed at its one end; a rear end plate formed with a bearing portion through which one end portion of the drive shaft is freely rotatably supported, the rear end plate also formed with at least a pair of openings, each of the openings being spaced at a predetermined distance from a center axis of the bearing portion of the rear end plate; and knock pins fixedly inserted in the openings of the rear end plate, disposed to engage the cam ring in the semicircular recess portions of the cam ring, and disposed with clearance in bores defined by the recess portions of the housing so that the cam ring is held and positioned only with respect to the rear end plate.

2 Claims, 3 Drawing Sheets

VANE PUMP WITH POSITIONING PINS FOR CAM RING

This application is a continuation of application Ser. No. 040,333, filed Apr. 20, 1987, now abandoned.

FIELD OF THE INVENTION

The present invention relates in general to a vane pump and in particular to a vane pump which is used in a power steering apparatus associated with an internal combustion engine.

SUMMARY OF THE INVENTION

In accordance with one important aspect of the present invention, there is provided a vane pump comprising a housing having front and rear surfaces and formed with a cam ring housing portion which is open to the front surface, the housing being further formed at its inner peripheral wall with recess portions and an axial bore extending from the rear surface, the axial bore being open to a center of the ring housing portion; a drive shaft freely rotatably supported in the axial bore of the housing; a rotor inserted on the drive shaft and engaged with the drive shaft, the rotor having a plurality of slits and a plurality of vanes each projectable from and retractable in the corresponding slit; a cam ring having at its inner peripheral wall a cam surface which is arranged to enclose the rotor therein and form pump chambers in cooperation with the vanes, the cam ring being formed at its outer peripheral wall with recess portions of substantially semicircular configuration in cross section; a front end plate by which the cam ring is closed at its one end; a rear end plate formed with a bearing portion through which one end portion of the drive shaft is freely rotatably supported, the rear end plate also being formed with at least a pair of openings, each of the openings being spaced at a predetermined distance from a center axis of the bearing portion of the rear end plate; and knock pins fixedly inserted in the openings of the rear end plate, disposed to engage the cam ring in the semicircular recess portions of the cam ring, and disposed with clearance in bores defined by the recess portions of the housing so that the cam ring is held and positioned only with respect to the rear end plate.

DESCRIPTION OF THE PRIOR ART

A conventional vane pump as shown in FIGS. 5 and 6 is disclosed in the U.S. Pat. No. 4,373,871. In FIG. 5, reference numeral 1 designates a housing formed with a housing bore 2. In the housing bore 2 is freely rotatable supported a drive shaft 4 through a bearing 3 secured to the housing 1. A pump portion generally indicated by reference numeral 5 is housed in the housing bore 2 of the housing 1 and includes a cam ring 6 having a cam surface 6*a* consisting of a large circular portion and a small circular portion, a rotor 7 freely rotatably supported in the cam ring 6 and having a plurality of equiangularly spaced slots formed therein, a plurality of vanes 8 radially movably received in the slots of the rotor 7, and front and rear plates 9 and 10 by which the cam ring 6 is closed at its opposite ends. The drive shaft 4 extends through a central opening formed in the front plate 9 and through a central opening formed in the rotor 7, and the rotor 7 is engaged with the drive shaft 4 through a spline formed in the drive shaft 4 between the front and rear plate 9 and 10. A rear end portion of the drive shaft 4 extending rearward from the rotor 7 is freely rotatably supported on a bearing portion 11 formed in the rear plate 10 through a bearing 12. The front plate 9, cam ring 6 and rear plate 10 are held together in assembled relationship by means of a pair of knock pins 14. Each of the knock pins 14 is inserted into a bore 13 formed in the inner surface of the housing 1, a bore 15 passing through the front plate 9, a bore 16 passing through the cam ring 6 and into a bore 17 formed in the rear plate 10 so that the center axis of the rotor 7 is consistent with the center axis of the cam surface 6*a* of the cam ring 6.

However, in such a conventional vane pump, in order that the center axis of the rotor 7 is consistent with the center axis of the cam surface 6*a* of the cam ring 6, the center axes of the bores 13, 15, 16 and 17 must be axially aligned with one another. If, therefore, one of the bore 13, 15, 16 and 17 is slightly offset from their common center axis, the center axis 7*b* L of the rotor 7 is slightly offset from the center axis 6*b* of the cam surface 6*a*. If the pump portion 5 is assembled with the center axis 7*b* of the rotor slightly offset from the center axis of 6*b* of the cam surface 6*a*, the vane pump is to be operated in this offset condition because the slight offset between the center axes 6*b* and 7*a* cannot be inspected visually. In this case, for instance, if the rotor 7 is rotated in the counter-clockwise direction indicated by an arrow B in FIG. 6 with the condition that the center axis 7*b* of the rotor 7 is offset slightly from the center axis 6*b* of the cam surface 6*a*, the vane 8*b* of two adjacent vanes 8*a* and 8*b*, which are located at the section between an intake port 6*c* and a discharge port 6*d* and which define a pump chamber 18, is slighly lengthened in its length from the outer surface of the rotor 7 to the cam surface 6*a* than the vane 8*b* in the condition that the center axis 7*a* of the rotor 7 is not offset. For this reason, the pump chamber 18 is slightly increased in its volume at the side of the vane 8*b*. On the other hand, the vane 8*d* of two adjacent vanes 8*c* and 8*d*, which are located at the section between the intake port 6*c* and the discharge port 6*d* and which define a pump chamber 19 opposite to the chamber 1, is slightly shortened in its length from the outer surface of the rotor 7 to the cam surface 6*a* than the vane 8*d* in the condition that the center axis 7*a* of the rotor 7 is not offset. For this reason, the pump chamber 19 is slightly decreased in its volume at the side of the vane 8*d*. Consequently, the fluid pressure in the pump chamber 19 becomes momentarily higher than the fluid pressure in the pump chamber 18 during rotation of the rotor 7, and therefore the rotor 7 is subjected to a force caused by the differential pressure between the chambers 18 and 19 in the direction indicated by an arrow A in FIG. 6. There is, on the other hand, a play between the drive shaft 4, and the housing 1 and rear plate 10 because the rotor 7 is splined to the drive shaft 4 and because the drive shaft 4 is supported on the housing 1 and rear plate 10 through the bearings 3 and 12. Consequently, when the rotor 7 is subjected to the force in the direction A, the drive shaft 4 oscillates together with the rotor 7, and therefore the oscillation and noise occur in the conventional vane pump. In order to avoid the occurrence of the oscillation and noise, the bore 13 of the housing 1, the bore 15 of the front plate 9, the bore 16 of the cam ring 6 and the bore 17 of the rear plate 10 must be cut accurately so that they are axially aligned with one another. The conventional vane pump, therefore, has the disadvantage that it necessitates a plurality of cutting operation and is expensive to manufacuture.

It is accordingly, an important object of the

BRIEF DESCRIPTION OF THE DRAWINGS

The drawbacks of a conventional vane pump and the features and advantages of a vane pump according to the present invention will be more clearly understood from the following description taken in conjunction with the accompanying drawings in which like reference numerals designate corresponding or similar members and structures throughout the figures of the drawings and in which.

DESCRIPTION OF THE PREFERRED EMBODIMENT

Figure 1:
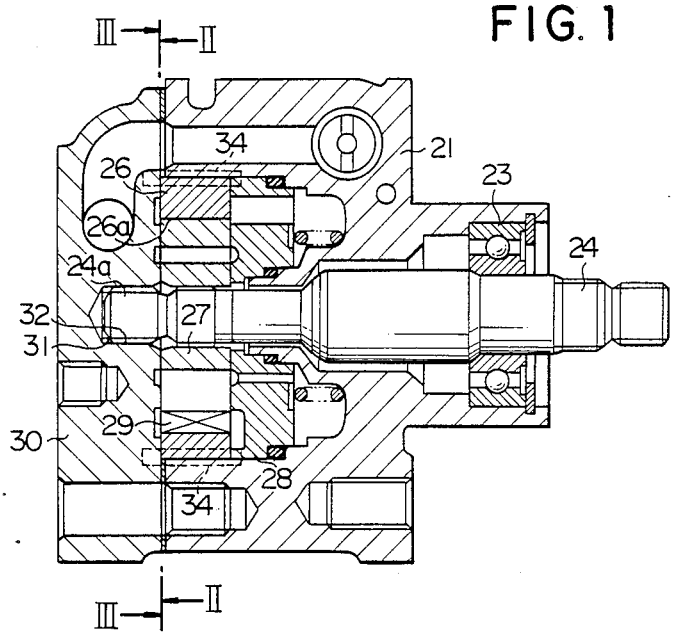
FIG. 1 is a cross sectional view showing one embodiment of a vane pump constructed in accordance with the present invention.
Figure 2:
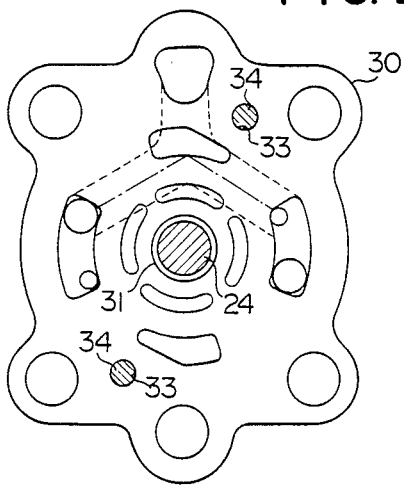
FIG. 2 is a cross sectional view substantially taken along line II—II indicated in FIG. 1.

Referring to FIGS. 1 to 4 of the drawings, which are views showing one embodiment of a vane pump constructed in accordance with the present invention and used in a power steering apparatus of an automotive vehicle, a pump housing is designated by reference numeral 21 and formed with a cam ring housing portion. The pump housing 21 has a drive shaft 24 freely rotatable supported therein through a front bearing 23 secured to the front boss portion of the housing 21. The drive shaft 24 is driven to rotate about its own axis by an engine (not shown) of the automotive vehicle. In the cam ring housing portion of the housing 21 are accommodated a cam ring 26 having a cam surface **26*a* consisting of a large circular portion and a small circular portion, a rotor 27 freely rotatably supported within the cam surface 26*a* of the cam ring 26, and a front end plate 28 by which the cam ring 26 is closed at the one end thereof. A rear end plate 30 closing the other end of the cam ring 26 is provided to hermetically seal the pump housing 21 as a rear cover. The rear end plate 30 is formed at the central portion thereof with a bearing bore 32 in which a rear end portion 24*a* of the drive shaft 24 extending through the front end plate 28 and rotor 27 is freely rotatably supported through a rear bearing 31 secured to the rear end plate 30. Thus, since the drive shaft 24 is supported in the bearing bore 32 through the bearing 31, the center axes of the bearing bore 32 and the rotor 27 are aligned with each other. As shown in FIG. 2, the rear end plate 30 is formed with a pair of knock pin bores 33 and 33 each of which is spaced a predetermined distance from the center axis of the bearing bore 32 and which are disposed symmetrically with respect to the center axis of the bearing bore 32. In each of the knock pin bores 33 and 33 is press fitted a knock pin 34. On the other hand, as clearly shown in FIG. 3, the cam ring 26 is formed at the outer peripheral wall thereof with a pair of recess portions 35 and 35 of substantially semicircular configuration in cross section. If the knock pins 34 and 34 press fitted in the knock pin bores 33 and 33 of the rear end plate 30 are engaged with the semicircular recess portions 35 and 35 of the cam ring 26, respectively, the cam ring 26 is to be attached to the rear end plate 30 and the center axis of the cam surface 26*a* of the cam ring 26 is to be axialy aligned with the center axis of the bearing bore 32 of the rear end plate 30. In addition, as clearly shown in FIG. 4, an inner peripheral wall of the cam ring housing portion 21*a* of the housing 21 and an outer peripheral wall of the front end plate 28 are formed with recess portions 36 and 37 of semicircular configuration in cross section, respectively. The semicircular recess portion 35 in formed in the outer peripheral wall of the cam ring 26, the semicircular recess portion 36 formed in the inner peripheral wall of the housing 21 and the semicircular recess portion 37 formed in the outer peripheral wall of the front end plate 28 as a whole constitute an alignment bore designated generally by reference numeral 38. The front end plate 28, cam ring 26 and rear end plate 3 are attached to the pump housing 21 by inserting the knock pin 34 press fitted in the rear end plate 30 in the alignment bore 38. It is noted that the recess portion 35 may be replaced with an axial bore formed in the cam ring 26, the center axis of the axial bore being parallel to the center axis of the cam ring 26**.

The operation of the vane pump thus constructed in accordance with the present invention will hereinafter be described in detail.

The front end plate 28 and rotor 27 are inserted on the drive shaft 24 accommodated in the housing 21, and the rotor 27 is mounted on the drive shaft 24 through the spline formed in the drive shaft 24. On the other hand, the cam ring 26 is engaged with the knock pins 34 press fitted in the rear end plate 30 through the semicircular recess portion 35 formed in the cam ring 26, and is attached to the rear end plate 30. As the cam ring 26 is attached to the rear end plate 30, the center axis of the bearing bore 32 in the rear end plate 30 and the center axis of the cam surface **26*a* are aligned with each other. The knock pins 34 are inserted in the alignment bores 38 constituted by the semicircular bores 35, 36 and 37 so that the cam ring 26 is accommodated in the cam ring housing portion 21*a* of the housing 21, and also the rear end portion 24*a* of the drive shaft 24 is inserted in the bearing bore 32 of the rear end portion 30 through the bearing 31. Since the drive shaft 24 is passed through the central portion of the rotor 27, the center axis of the cam surface 26*a* and the center axis of the rotor 27** are aligned with each other.

Thus, in order to align the center axis of the cam surface **26*a* with the center axis of the rotor 27, the cam ring 26 is dependent upon the knock pins 34. Consequently, only the semicircular recess portions 35 of the cam ring 26 engaged by the knock pins 34** are required to be cut accurately, and thus the accuracy is easily obtainable as compared with the aforementioned prior art.

In addition, even if the semicircular recess portion 36 formed in the housing 21, the semicircular recess portion 37 formed in the front end plate 28 and the inner surface of the housing 21 were cut roughly, there would be no problem because the center axis of the cam surface **26*a* and the center axis of the rotor 27 is aligned only by the knock pins 34. As a result, it is not necessary to cut with accuracy the recess portions 36, 37 and the inner surface 21*a***, and thus the cost of production of the vane pump can be reduced.

Furthermore, in accommodating the cam ring 26 attached to the rear end portion 30 in the cam ring housing portion of the housing 21 and inserting the rear end portion 24*a* of the drive shaft 24 in the bearing bore 32 formed in the rear end plate 30, since the cam ring 26 depends upon only the knock pins 34, the center axis of the cam surface 26*a* and the center axis of the rotor 27 are not offset from each other.

Figure 3:
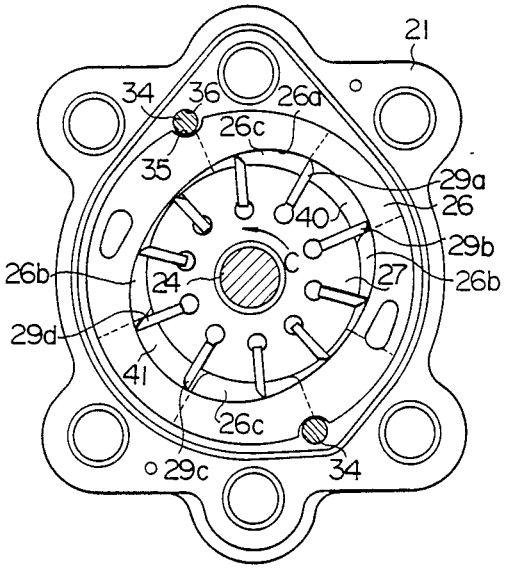
FIG. 3 is a cross sectional view substantially taken along line III—III indicated in FIG. 1.
Figure 4:
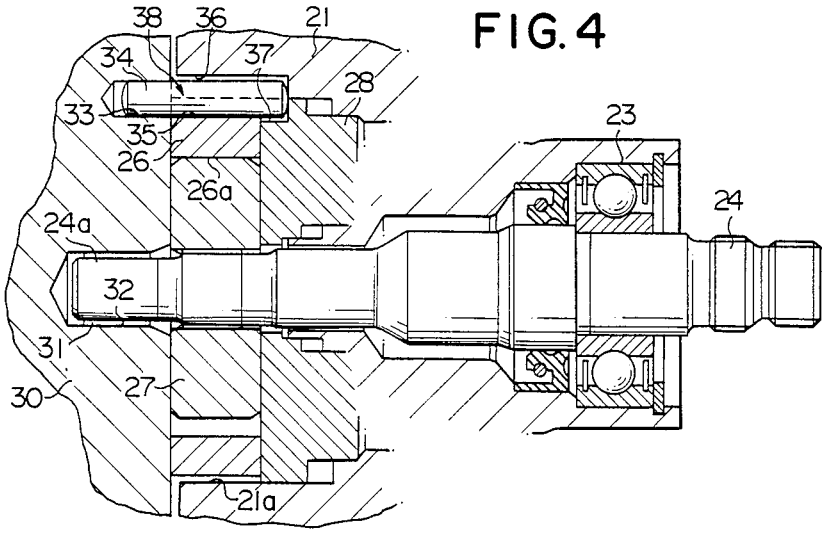
FIG. 4 is a cross sectional view of a knock pin by which a center axis of a rotor is aligned with a center axis of a cam ring.
Figure 5:
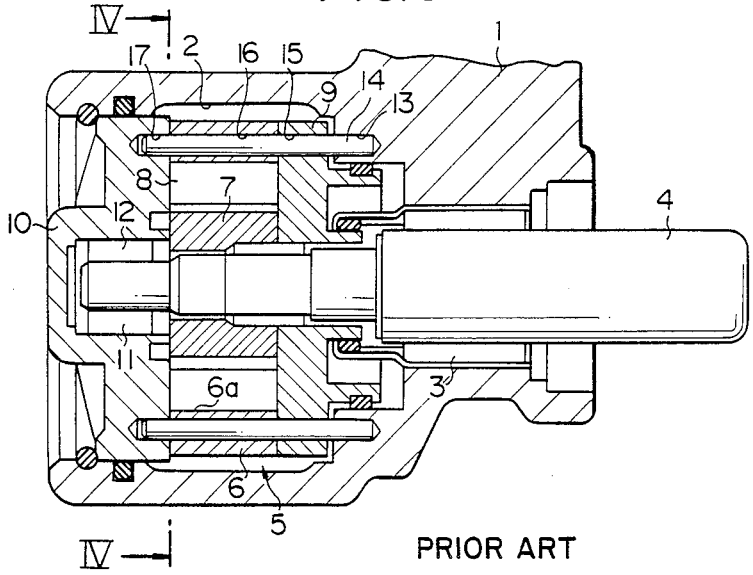
PRIOR ART FIG. 5
FIG. 5 is a cross sectional view showing the conventional vane pump.
Figure 6:
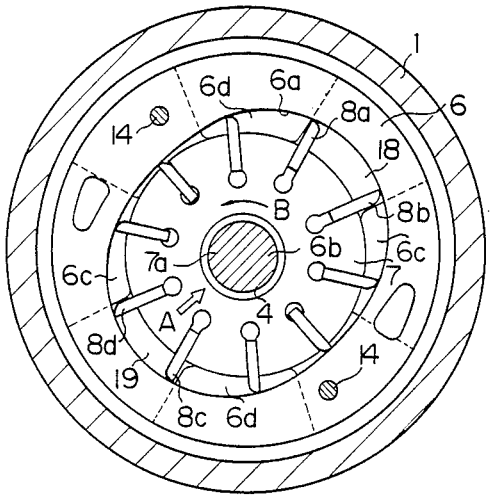
PRIOR ART FIG. 6
FIG. 6 is a cross sectional view substantially taken along line VI—VI indicated in FIG. 5.

Hence, when the vane pump thus assembled is operated, the rotor 27 rotates in the direction indicated by an arrow C in FIG. 3, and a pump chamber 40 defined by two adjacent vanes 29*a* and 29*b* which are located in the section between an intake port 26*b* and a discharge port 26*c* is substantially equal in volume to a pump chamber 41 defined by two adjacent vanes 29*c* and 29*d* which are located in the section between the intake port 26*b* and the discharge port 26*c*. Therefore, a differential pressure does not occur between the working oil in the pump chambers 40 and 41. For this reason, the rotor 27 is not subjected to a force caused by the differential pressure, and thus the oscillation and noise of the vane pump is considerably reduced.

From the foregoing description, it will be seen that an improved vane pump which can prevent the oscillation and noise and which can reduce the cost of production is afforded by the present design. That is, the center axis of the cam surface of the cam ring and the center axis of the rotor are capable of being aligned with each other only by engaging the cam ring with the knock pins mounted in the rear end plate. Accordingly, other accurate cutting operations are not necessary, thereby reducing the cost of production. In addition, since the center axis of the cam surface of the cam ring and the center axis of the rotor are not offset from each other in assembling, the oscillation and noise do not occur during operation of the vane pump according to the present invention.

It should be noted that the foregoing description relates only to a preferred embodiment of the present invention and that certain obvious modifications and alternations may be made without departing from the spirit or scope of the invention.

What we claim is:

1. A vane pump comprising a housing having front and rear surfaces and an inner peripheral wall, said housing being formed with a cam ring housing portion which is open to said front surface, the housing being further formed at its peripheral wall with recess portions and an axial bore extending from said rear surface, said axial bore being open to a center of said cam ring housing portion;

a drive shaft freely rotatably supported in said axial bore of said housing;

a rotor inserted on said drive shaft and engaged with said drive shaft, the rotor having a plurality of slits and a plurality of vanes, each vane projectable from and retractable in a corresponding slit;

a cam ring having open ends, an inner peripheral wall and, at its inner peripheral wall, a cam surface which surrounds said rotor and forms pump chambers in cooperation with said vanes, said cam ring further having an outer peripheral wall and, at its outer peripheral wall, recess portions of substantially semicircular configuration in cross section;

a front end plate by which said cam ring is closed at one end;

a rear end plate formed with a bearing portion through which one end portion of said drive shaft is freely rotatably supported, the rear end plate also formed with at least a pair of openings, each of said openings being spaced at a predetermined distance from a center axis of said bearing portion of said rear end plate; and knock pins fixedly inserted in said at least a pair of openings of said rear end plate, disposed to engage said cam ring in said semicircular recess portions of said cam ring, and disposed with clearance in bores defined by said recess portions of said housing so that said cam ring is held and positioned only with respect to said rear end plate.

2. A vane pump as set forth in claim 1, wherein said knock pins are mounted in said rear end plate by a press fit.

* * * * *